US008261559B2

(12) United States Patent
Tanaka

(10) Patent No.: US 8,261,559 B2
(45) Date of Patent: Sep. 11, 2012

(54) CRYOPUMP

(75) Inventor: Hidekazu Tanaka, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 650 days.

(21) Appl. No.: 12/458,191

(22) Filed: Jul. 2, 2009

(65) Prior Publication Data

US 2010/0000235 A1 Jan. 7, 2010

(30) Foreign Application Priority Data

Jul. 4, 2008 (JP) ..... 2008-176174

(51) Int. Cl.
*B01D 8/00* (2006.01)

(52) U.S. Cl. ..... 62/55.5; 417/901

(58) Field of Classification Search ..... 62/55.5, 62/55.1, 268, 269; 417/901
See application file for complete search history.

(56) References Cited

U.S. PATENT DOCUMENTS 7,523,618 B2 * 4/2009 Tanaka ..... 62/55.5

FOREIGN PATENT DOCUMENTS

| | | | |
|---|---|---|---|
| JP | 02-011870 | A | 1/1990 |
| JP | 2004-239239 | A | 8/2004 |
| JP | 2007-132273 | A | 5/2007 |
| JP | 2007-327396 | A | 12/2007 |
| WO | WO-2005/050018 | A1 | 6/2005 |

OTHER PUBLICATIONS

Notification of Reason(s) for Refusal in Japanese Patent Application No. 2008-176174, dated May 15, 2012.
Notification of Reason(s) for Refusal in Japanese Patent Application No. 2008-211784, dated May 15, 2012.

* cited by examiner

*Primary Examiner* — Chen Wen Jiang
(74) *Attorney, Agent, or Firm* — Rader, Fishman & Grauer PLLC

(57) ABSTRACT

A cryopump includes a radiation shield provided with a main inlet at one end thereof and a sub-inlet in a side thereof; and a cryopanel assembly cooled to a temperature lower than that of the radiation shield. The cryopanel assembly includes an upper structure having at least one cryopanel and a lower structure having at least one cryopanel. The upper and lower structures are arranged inside the radiation shield along a direction away from the main inlet. A frost accommodating space connected to the sub-inlet may be arranged between the upper and lower structures such that an amount of captured gas on an upper end cryopanel of the lower structure is greater than an amount of captured gas on a lower end cryopanel of the upper structure.

6 Claims, 4 Drawing Sheets

CRYOPUMP

BACKGROUND OF THE INVENTION

1. Field of the Invention

The present invention relates to a cryopump.

2. Description of the Related Art

A cryopump is a vacuum pump that captures and pumps gas molecules by condensing or adsorbing molecules on a cryopanel cooled to an extremely low temperature. A cryopanel is generally used to achieve a clean vacuum environment required in a semiconductor circuit manufacturing process.

A cryopump having a heat shield plate provided with a cutout for enabling an inflow of gas molecules and an additional shield for preventing radiation heat from entering through the cutout is disclosed for example in Patent Documents 1 and 2. In this cryopump, a process gas entering into a space between the heat shield plate and the cryopump container is received inside the heat shield plate and is condensed and pumped on the second stage panels. Therefore, the heat transfer from the cryopump container to the heat shield plate via the process gas is reduced, and thereby the temperature rise of the heat shield plate and deterioration of cryopumping performance are mitigated or prevented.

[Patent Document 1] WO2005/050018

[Patent Document 2] JP2007-132273

The gas molecules condensed on a cryopanel accumulate as frost and/or ice. When it grows up and contacts to the heat shield plate having a higher temperature, re-vaporization starts and the cryopump does not perform further evacuation. An amount of condensed gas on the cryopanels before the contact significantly influences the maximum amount of condensed gas in the cryopump. In case that the heat shield plate has a cutout and an additional shield, the additional shield may restrict the maximum amount of condensed gas due to the contact between the additional shield and the accumulated frost on the second stage panels.

Also, the ice may concentrate on the top panel in the second stage panels as a gas enters mainly from an opening at the top end of the heat shield plate. The thick ice layer deposited on the top panel may have a higher temperature at its surface than the top panel due to a temperature gradient in the ice layer. The surface temperature of the ice layer also influences the maximum amount of condensed gas in the cryopump. When the vapor pressure on the surface of the ice layer exceeds the degree of vacuum to be attained, vaporization from the ice layer is predominant over gas condensation from ambient atmosphere to the ice layer, and hence further evacuation cannot be performed.

SUMMARY OF THE INVENTION

Therefore, a purpose of the present invention is to increase the maximum amount of condensed gas in a cryopump which allows a gas inflow through a side of a radiation shield.

According to an aspect of the invention, there is provided a cryopump including a radiation shield provided with a main inlet at one end thereof and a sub-inlet in a side thereof, and a cryopanel assembly cooled to a temperature lower than that of the radiation shield. The cryopanel assembly includes an upper structure having at least one cryopanel and a lower structure having at least one cryopanel. The upper and lower structures are arranged inside the radiation shield along a direction away from the main inlet. A frost accommodating space connected to the sub-inlet is arranged between the upper and lower structures such that an amount of captured gas on an upper end cryopanel of the lower structure is greater than an amount of captured gas on a lower end cryopanel of the upper structure.

This may increase the amount of captured gas on the lower structure and mitigate overconcentration on the upper structure. The potential capacity of the lower structure may be effectively utilized and the maximum amount of captured gas may be improved.

According to another aspect of the invention, there is provided a cryopump including a radiation shield including a main shield provided with a main inlet at one end thereof and a sub-inlet in a side thereof, and a additional shield facing to the sub-inlet, and a plurality of cryopanels surrounded by the radiation shield and arranged spaced apart each other along a direction from the main inlet to an internal volume of the radiation shield. A gap between a cryopanel closest to the additional shield and a cryopanel adjacently arranged towards a bottom of the radiation shield is different from a gap between the cryopanel closest to the additional shield and a cryopanel adjacently arranged towards the main inlet.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
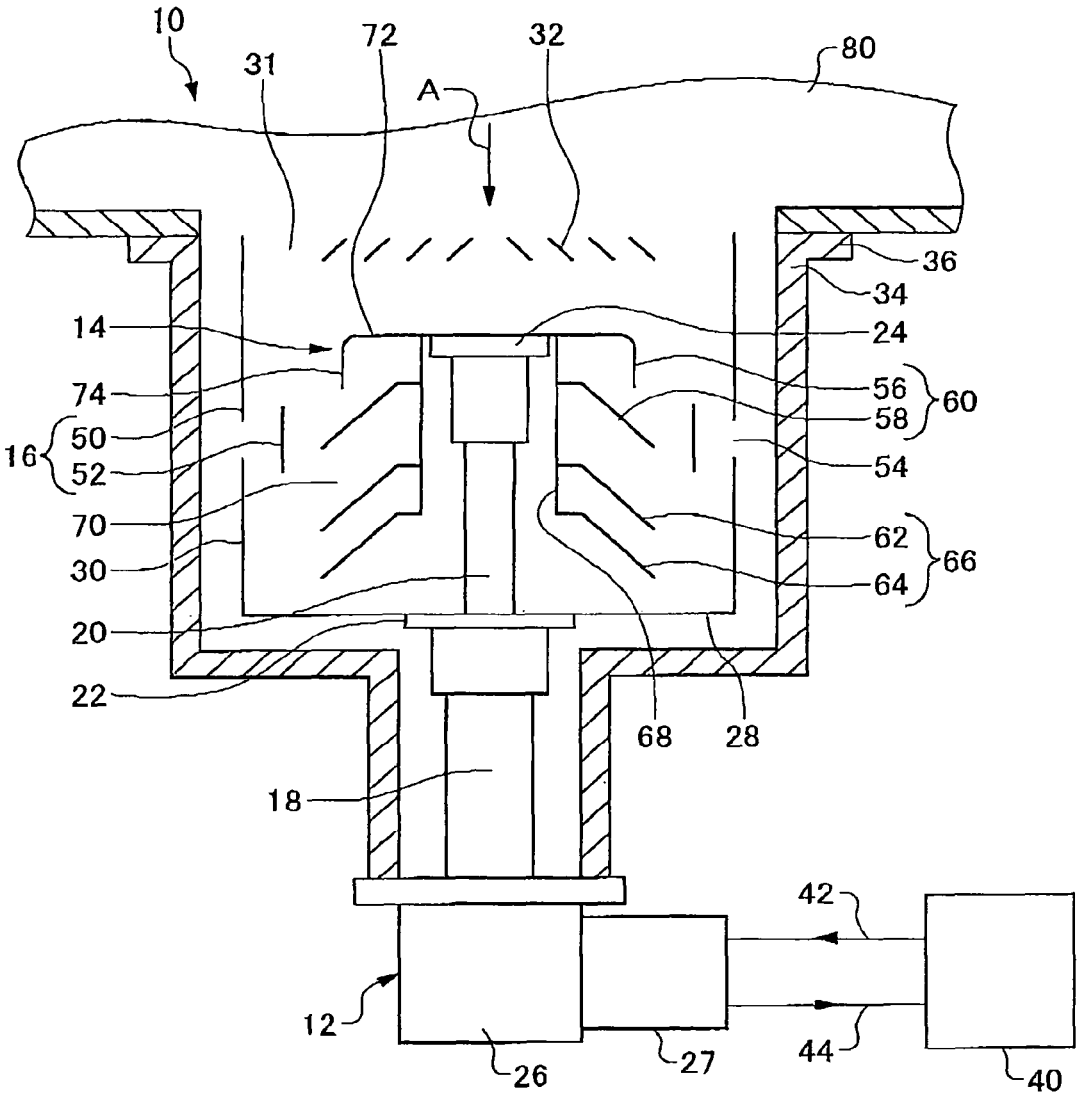
FIG. 1 schematically shows a cryopump according to an embodiment of the present invention.

The present invention will now be described by reference to preferred embodiments. This does not intend to limit the scope of the invention, but to exemplify the invention. According to an embodiment, a cryopump has a cryopanel assembly having a first sub-assembly and a second sub-assembly. The first sub-assembly has at least one cryopanel, and the second sub-assembly also has at least one cryopanel. On a radiation shield surrounding the cryopanel assembly are formed not only a main inlet facing to a cryopump opening but also a sub-inlet. In this cryopump, there is provided a gas inflow path facilitating the incoming of gas molecules to the second sub-assembly. The gas inflow path includes the sub-inlet of the radiation shield, and a frost accommodating space. The accommodating space is formed between the first sub-assembly and the second sub-assembly, i.e., above the second sub-assembly. It facilitates the pumping by the second sub-assembly and mitigates concentration of gas condensed on the first sub-assembly. The pumping capacity of the second sub-assembly is utilized to improve the maximum amount of captured gas in the cryopump.

In an embodiment, the cryopump is provided with a first cryopanel cooled to a first cooling temperature level and a second cryopanel cooled to a second cooling temperature level lower than the first cooling temperature level. The first cryopanel condenses and captures a gas having a low vapor pressure, e.g. a vapor pressure lower than a reference vapor pressure (e.g., $10^{-8}$ Pa) at the first cooling temperature level so as to pump the gas accordingly. The second cryopanel condenses and captures a gas having a low vapor pressure at the second cooling temperature level so as to pump the gas accordingly. In order to capture a non-condensable gas that cannot be condensed at the second temperature level due to a high vapor pressure, an adsorption area is formed on the surface of the second cryopanel. The adsorption area is formed by, for example, providing an adsorbent on the panel surface. A non-condensable gas is adsorbed by the adsorption area cooled to the second temperature level and pumped.

In an embodiment, the cryopump has a bottomed cylindrical radiation shield provided with a main gas inlet at one end thereof and a sub-inlet on a side thereof. The main inlet is for example a shield opening provided at a location corresponding to an opening of a vacuum chamber. The sub-inlet is for example an intake slit formed annularly on the side of the radiation shield. The radiation shield is thermally connected to a first cooling stage of a refrigerator and cooled to the first cooling temperature level. The radiation shield may include an additional shield facing to the sub-inlet. The radiation shield surrounds the cryopanel assembly therein. The cryopanel assembly has a plurality of cryopanels. The cryopanel assembly is thermally connected to a second cooling stage of the refrigerator and cooled to the second cooling temperature level.

In the cryopump according to an embodiment, a frost accommodating space is provided adjacent to the sub-inlet and connected to the sub-inlet. The frost accommodating space occupies a location associated with the position of the sub-inlet in a direction from the main inlet to the inside of the shield, i.e. the direction along the shield central axis.

For example, the cryopump has a plurality of cryopanels arranged along a direction from the main inlet to the inside of the radiation shield and spaced apart each other. The plurality of cryopanels may be arranged such that the gap between two adjacent cryopanels closest to the sub-inlet in the arranging direction is wider than a gap between any other two adjacent cryopanels. In other words, the plurality of cryopanels may be arranged such that the gap closest to the additional shield between two adjacent cryopanels in the arranging direction is wider than a gap between any other two adjacent cryopanels. In this way, the frost accommodating space is provided with a sufficient volume between the two adjacent cryopanels closest to the sub-inlet and/or additional shield.

The gap between the cryopanel closest to the additional shield and its adjacent cryopanel at the bottom side of the radiation shield may be different from the gap between the cryopanel closest to the additional shield and its adjacent cryopanel at the opening side of the radiation shield. For example, the gap between the cryopanel closest to the additional shield and its adjacent cryopanel at the bottom side of the radiation shield may be wider than the gap between the cryopanel closest to the additional shield and its adjacent cryopanel at the opening side of the radiation shield. In other words, the gap between the cryopanel closest to the sub-inlet and its adjacent cryopanel at the bottom side of the radiation shield may be wider than the gap between the cryopanel closest to the sub-inlet and its adjacent cryopanel at the opening side of the radiation shield. In this way, the frost accommodating space is provided with a sufficient volume between the cryopanel closest to the sub-inlet and/or the additional shield and one of the adjacent cryopanels. Alternatively, the gap between the cryopanel closest to the sub-inlet and/or the additional shield and its adjacent cryopanel at the opening side of the radiation shield may be wider if the cryopanel closest to the sub-inlet and/or the additional shield is located closer to the lower end than the upper end of the sub-inlet and/or the additional shield.

The cryopanel assembly may include an upper sub-assembly and a lower sub-assembly arranged in the radiation shield along a direction away from the main inlet. Both of the upper and lower sub-assemblies have at least one cryopanel. A position of the interval between the upper and lower sub-assemblies in the direction is associated with the position of the sub-inlet and/or the additional shield in that direction. In this way, a frost accommodating space is formed between the upper sub-assembly and the lower sub-assembly. It may be desirable that the frost accommodating space is arranged such that the top cryopanel in the lower sub-assembly achieves more pumping capacity than the bottom cryopanel in the upper sub-assembly. In this case, the top cryopanel in the lower sub-assembly may be utilized to condense a significant amount of gas thereon. This may lead to mitigate the concentration of condensed gas on the upper sub-assembly, and allow the cryopanel assembly in total to condense more amount of gas thereon.

It should be appreciated that the term such as "upper", "lower", "top", and "bottom" are used for ease of understanding and they are not intended to limit the position of an element in the vertical direction. Therefore, the term such as "upper" and "top" indicates that an indicated element is relatively close to the main inlet while the term such as "lower" and "bottom" indicates that an element is relatively far from the main inlet. In other wards, the term such as "upper" and "top" indicates that an element is relatively far from the bottom of the cryopump while the term such as "lower" and "bottom" indicates that an element is relatively close to the bottom of the cryopump.

In an embodiment, the cryopump may include a cryopanel provided with a surface traversing a gas inflow direction from the sub-inlet and the surface facing adjacently towards the frost accommodating space. Alternatively, The cryopump may have a cryopanel arranged on a constant-pressure surface generated around the sub-inlet during the pumping operation of the cryopump.

In an embodiment where a cryopanel is disposed in the upper region above the sub-inlet of the cryopump internal space, that cryopanel may be preferably arranged to traverse the direction in which a gas inflow passes through the sub-inlet. Also, one or more cryopanels closer to the sub-inlet in the upper region may be arranged to traverse the gas inflow direction through the sub-inlet. The cryopanel may have a condensing surface and an adsorbing surface thereon. The condensing surface may be arranged to make an acute angle with the gas inflow direction, and the adsorbing surface may be arranged to make an obtuse angle with the gas inflow direction. The condensing surface may be arranged on a constant-pressure surface generated around the sub-inlet and to be exposed to the sub-inlet. The adsorbing surface may be hidden from the sub-inlet. In this case, for example, the condensing surface and the adsorbing surface may be a cryopanel surface facing towards the sub-inlet and the back surface thereof, respectively.

In an embodiment, the top cryopanel closest to the main inlet may have a central panel facing to the main inlet and a peripheral panel extending from a peripheral portion of the central panel towards a cryopanel adjacent to the top cryopanel. The peripheral panel may extend away from the main inlet and obliquely with respect to the cryopanel adjacent to the top cryopanel. The peripheral cryopanel may extend downwardly at a deeper angle than the cryopanel adjacent to the top cryopanel.

In an embodiment where a cryopanel is disposed in the upper region of the cryopump internal space above the sub-inlet, a peripheral part of the cryopanel may be extend radially outwardly and downwardly from a center part of the cryopanel. For example, the peripheral panel may extend downwardly at a deeper angle than a line extending from a peripheral edge of the central panel to an upper edge of the sub-inlet.

In an embodiment where the additional shield is provided, one or more cryopanels may be preferably arranged in a lower region of the cryopump internal space below a lower edge of the additional shield, i.e. in the bottom space in the cryopump. A gas inflow through the sub-inlet may also be condensed on the lower cryopanels, and the concentration of condensed gas on the upper cryopanels may be mitigated. This may improve the maximum capacity of condensation of the cryopump.

FIG. 1 is a cross-sectional view schematically illustrating a cryopump 10 according to an embodiment of the invention. The cryopump 10 is mounted to a vacuum chamber 80 of an apparatus, such as an ion implantation apparatus and a sputtering apparatus, that requires a high vacuum environment. The cryopump 10 is used to enhance the degree of vacuum in the vacuum chamber 80 to a level required in a desired process. For example, the cryopump 10 achieves a high degree of vacuum of about $10^{-5}$ Pa to about $10^{-8}$ Pa.

The cryopump 10 is provided with a refrigerator 12, a panel assembly 14, and a heat shield 16. The panel assembly 14 includes a plurality of cryopanels, which are cooled by the refrigerator 12. A cryogenic temperature surface for capturing a gas by condensation or adsorption so as to pump the gas, is formed on the cryopanels. The surface (e.g., rear face) of the cryopanel is normally provided with an adsorbent such as activated carbon or the like in order to adsorb a gas.

The cryopump 10 is a so-called vertical-type cryopump, where the refrigerator 12 is inserted and arranged along the axial direction of the heat shield 16. The present invention is also applicable to a so-called horizontal-type cryopump alike, where the second cooling stage of the refrigerator is inserted and arranged in the (usually orthogonal) direction intersecting with the axial direction of the heat shield 16.

The refrigerator 12 is a Gifford-McMahon refrigerator (so-called GM refrigerator). The refrigerator 12 is a two-stage refrigerator comprising a first stage cylinder 18, a second stage cylinder 20, a first cooling stage 22, a second cooling stage 24, and a refrigerator motor 26. The first stage cylinder 18 and the second stage cylinder 20 are connected in series, in which a first stage displacer and a second stage displacer (not illustrated), which are connected together, are respectively built in. A regenerator is incorporated into the first stage displacer and the second stage displacer. The refrigerator 12 may be one other than the two-stage GM refrigerator, for example, a pulse tube refrigerator may be used.

The refrigerator motor 26 is provided at one end of the first stage cylinder 18. The refrigerator motor 26 is provided inside a motor housing 27 formed at the end portion of the first stage cylinder 18. The refrigerator motor 26 is connected to the first stage displacer and the second stage displacer such that the first stage displacer and the second stage displacer can reciprocally move inside the first stage cylinder 18 and the second stage cylinder 20, respectively. The refrigerator motor 26 is connected to a movable valve (not illustrated) provided inside the motor housing 27 such that the valve can move in the forward direction and the reverse direction.

The first cooling stage 22 is provided at the end portion of the first stage cylinder 18 on the side of the second stage cylinder 20, i.e., at the connecting portion between the first stage cylinder 18 and the second stage cylinder 20. The second cooling stage 24 is provided at the terminal portion of the second stage cylinder 20. The first cooling stage 22 and the second cooling stage 24 are respectively fixed to the first stage cylinder 18 and the second stage cylinder 20 by, for example, brazing.

A compressor 40 is connected to the refrigerator 12 by a high pressure piping 42 and a low pressure piping 44. The refrigerator 12 expands within it an operating gas (e.g., helium) with a high pressure supplied from the compressor 40 so as to generate a cold state at the first cooling stage 22 and the second cooling stage 24. The compressor 40 recovers the operating gas expanded inside the refrigerator 12 and repressurize the gas to supply to the refrigerator 12.

Specifically, the operating gas with a high pressure is supplied to the refrigerator 12 from the compressor 40 through the high pressure piping 42. At the same time, the refrigerator motor 26 drives the movable valve inside the motor housing 27 such that the high pressure piping 42 and the inside space of the refrigerator 12 are connected to each other. When the inside space of the refrigerator 12 is filled with the operating gas with a high pressure, the inside space of the refrigerator 12 is connected to the low pressure piping 44 with the refrigerator motor 26 switching the movable valve. Thereby, the operating gas is expanded and recovered into the compressor 40. Synchronized with the operation of the movable valve, the first stage displacer and the second stage displacer reciprocally move inside the first stage cylinder 18 and the second stage cylinder 20, respectively. By repeating such a heat cycle, the refrigerator 12 generates cold states in the first cooling stage 22 and the second cooling stage 24. In the compressor 40, a compression cycle in which the operating gas discharged from the refrigerator 12 is compressed to a high pressure and delivered into the refrigerator 12, are repeated.

The second cooling stage 24 is cooled to a temperature lower than that of the first cooling stage 22. The second cooling stage 24 is cooled to, for example, approximately 10 K to 20 K, while the first cooling stage is cooled to, for example, approximately 80 K to 100 K. A first temperature sensor is mounted in the first cooling stage 22 in order to measure a temperature thereof, and a second temperature sensor is mounted in the second cooling stage 24 in order to measure a temperature thereof.

The heat shield 16 is fixed to the first cooling stage 22 of the refrigerator 12 in a thermally connected state, while the panel assembly 14 is connected to the second cooling stage 24 thereof in a thermally connected state. Thereby, the heat shield 16 is cooled to a temperature substantially equal to that of the first cooling stage 22, while the panel assembly is cooled to a temperature substantially equal to that of the second cooling stage 24.

The heat shield 16 is provided to protect both of the panel assembly 14 and the second cooling stage 24 from ambient radiation heat. The heat shield includes a main shield 50 and an additional shield 52. The main shield 50 is formed into a cylindrical shape having an opening 31 at its one end. The shield opening 31 is defined by the interior surface at the end of the cylindrical side face 30 of the heat shield 16.

An intake slit 54 is formed on the shield side 30. The intake slit 54 is circumferentially formed at a center position on the shield side 30 so as to surround the shield central axis in a plane perpendicular to the axis. The intake slit 54 has a constant width in the axial direction. The intake slit 54 allows a gas entering from an outer space between the heat shield 16 and a pump case 34 into the shield inside. This may provide a decrease in gas pressure in the space between the heat shield 16 and a pump case 34. Consequently, heat transfer to the heat shield 16 via gas molecules may be reduced and a temperature increase of the heat shield 16 may be mitigated. It will be appreciated that the shield opening 31 is served as a main gas inlet, and the intake slit 54 is served as a sub-inlet. The sub-inlet may be in any configuration other than the slit. The sub-inlet may be openings circumferentially formed at intervals on the shield side 30. The sub-inlet may be formed on the bottom of the heat shield 16.

The intake slit 54 separates the main shield 50 into a hollow cylindrical upper shield and a bottomed cylindrical lower shield. The upper and lower shields are connected by connection members at different circumferential positions, e.g. at four positions every ninety degrees. The additional shield 52 may also be attached to the connection members.

The additional shield 52 is disposed inside the main shield 50 to face towards the sub-inlet. The additional shield 52 is an annular member wider than the intake slit 54. The additional shield 54 extends upwardly above an upper edge of the intake slit 54 and downwardly below a lower edge of the intake slit 54 such that the cryopanel assembly 14 is invisible from the intake slit 54. The additional shield 52 is configured to optically close the sub-inlet when seen from the outside of the heat shield 16. Therefore, the radiation shield shields the incoming radiation from entering into the inside through the sub-inlet. A configuration of the additional shield 52 and/or the intake slit 54 may be arranged by taking a conductance of gas flowing in through the sub-inlet into account. Alternatively, the additional shield 52 may be disposed outside the main shield 50.

The main shield 50 and the additional shield 52 are for example made of copper or aluminum. Alternatively, the main shield 50 and the additional shield 52 may be made of different materials. For example, the upper shield of the main shield 50 may be made of a high thermal conductive material, e.g. copper, and the lower shield and the additional shield 52 may be made of a low heat capacity material, e.g. aluminum. A coating such as a radiation-adsorbing layer, e.g. a black coating may be made on a surface of the main shield 50 and the additional shield 52.

It is preferable that the sub-inlet is formed at a position on a center part or therebelow of the shield side 30 in the shield axial direction. In an embodiment where the sub-inlet is formed on an upper part of the shield, an outflow of gas from inside to outside through the sub-inlet, i.e. an outflow to the outer space between the outer surface of the shield and the pump case, may be dominant. It may be possible to ensure the gas flow through the sub-inlet to flow into the inside of the shield by forming the sub-inlet at a position on the center part or therebelow of the shield side 30.

On the other hand, on the side opposite to the shield opening 31, i.e., at the other end on the pump bottom side, an occluded portion 28 is formed. The occluded portion 28 is formed by a flange portion extending toward the inside of the radial direction at the end portion on the pump bottom side of the cylindrical side face of the heat shield 16. As the cryopump 10 illustrated in FIG. 1 is a vertical-type cryopump, the flange portion is mounted in the first cooling stage 22 of the refrigerator 12. Thereby, a cylindrically shaped inside space is formed within the heat shield 16. The refrigerator 12 protrudes into the inside space along the central axis of the heat shield 16, and the second cooling stage 24 remains inserted in the inside space.

In the case of a horizontal-type cryopump, the refrigerator 12 is arranged so as to protrude into the internal space along the direction orthogonal to the central axis of the heat shield 16 from the opening for attaching the refrigerator, formed on the side face of the heat shield 16. The first cooling stage 22 of the refrigerator 12 is mounted in the opening for attaching the refrigerator in the heat shield 16, while the second cooling stage 24 thereof is arranged in the internal space of the shield. On the second cooling stage 24, is mounted the panel assembly 14. Therefore, the panel assembly 14 is arranged in the inside space of the heat shield 16. Alternatively, the panel assembly 14 may be mounted to the second cooling stage 24 via an appropriately shaped panel-mounting member.

The heat shield 16 may not be cylindrical in shape but may be a tube having a rectangular, elliptical, or any other cross section. Typically, the shape of the heat shield 16 is similar to the shape of the interior surface of a pump case 34. The heat shield 16 may not be formed as a one-piece cylinder. A plurality of parts may form a cylindrical shape as a whole. The plurality of parts may be provided so as to create a gap between the parts.

A baffle 32 is provided in the shield opening 31. The baffle 32 is provided to protect the second cooling stage 24 and low temperature cryopanels thermally connected thereto from radiation heat emitted from the vacuum chamber. The baffle 32 is provided spaced apart from the panel assembly 14 in the direction of the central axis of the heat shield 16. The baffle 32 is mounted in the end portion at the opening of the upper shield of the main shield 50, and is cooled to a temperature substantially equal to that of the heat shield 16. The baffle 32 may be formed, for example, in a louver arrangement or a chevron arrangement. The baffle 32 may be formed, for example, concentrically, or into other shapes such as a lattice shape, etc., when seen from the vacuum chamber 80. A gate valve (not illustrated) is provided between the baffle 32 and the vacuum chamber 80. The gate valve is, for example, closed when the cryopump 10 is regenerated and opened when the vacuum chamber 80 is evacuated by the cryopump 10.

The heat shield 16, the baffle 32, the panel assembly 14, and the first cooling stage 22, and the second cooling stage 24 of the refrigerator 12, are contained inside the pump case 34. The pump case 34 is formed by connecting in series two cylinders, diameters of which are different from each other. The end portion of the cylinder with a larger diameter is opened, and a flange portion 36 for connection with the vacuum chamber 80 is formed extending toward the outside of the radial direction. The pump case 34 and the heat shield 16 are both formed into cylindrical shapes and arranged concentrically. Because the inner diameter of the pump case 34 is slightly larger than the outer diameter of the heat shield 16, the heat shield 16 is arranged slightly spaced apart from the interior surface of the pump case 34. The end portion of the cylinder with a smaller diameter of the pump case 34 is fixed to the motor housing 27. The cryopump 10 is fixed to an evacuation opening of the vacuum chamber 80 in an airtight manner through the flange portion 36 of the pump case 34, allowing an airtight space integrated with the inside space of the vacuum chamber 80 to be formed.

The cryopanel assembly 14 has a plurality of cryopanels arranged along a gas inflow direction A that is a direction from the shield opening 31 to the inside of the shield. These cryopanels are spaced apart each other in the direction. The arranging direction of the cryopanels is coincident with the direction along the central axis of the heat shield 16. The intervals between adjacent cryopanels are nonuniformly arranged at the position of the intake slit 54 in the arranging direction such that a frost accommodating space 70 is formed. The interval of adjacent cryopanels at the position of the frost accommodating space 70 is wider in the axial direction.

Each cryopanel has a shape of the side surface of a truncated corn, i.e., an umbrella-like shape. The cryopanels are mounted on a panel-mounting member 68 mounted on the second cooling stage 24. Each cryopanel has a circular mounting part extending radially from the panel mounting member 68 in a plane perpendicular to the shield central axis, and a panel side extending from the mounting part radially outwardly away from the shield opening 31. In the present embodiment, the top cryopanel 56 has a different configuration from the other cryopanels as described below in detail. An adsorbent (not illustrated) such as activated carbon is provided in the rear surface of the panel side, while it is not provided in the front surface of the panel side towards the shield opening 31. The front surface of the cryopanel is used as a condensing surface and the rear surface is used as an adsorbing surface.

In the present embodiment, a gap between the cryopanel 58 closest to the additional shield 52 and a cryopanel 56 adjacent to the cryopanel 58 on the shield opening side is different in size from a gap between the cryopanel 58 and the other cryopanel 62 adjacent to the cryopanel 58 on the shield bottom side. Specifically, the gap between the cryopanel 58 and the adjacent cryopanel 62 on the bottom side is wider than that of the cryopanel 58 and the adjacent cryopanel 56 on the opening side. Such a wide gap between the adjacent cryopanels 58, 62 closest to the additional shield 52 provides a large volume 70 for accommodating frost, to which the intake slit 54 is adjacently connected.

The cryopanel assembly 14 is sectionalized into an upper structure 60 and a lower structure 66. The upper and lower structures 60, 66 are arranged in sequence in the direction from the shield opening 31 to the shield inside. The upper and lower structures 60, 66 may have one or more cryopanels. In the present embodiment, two cryopanels are included in both of the upper and lower structures 60, 66. The upper structure 60 has a top cryopanel 56 closest to the shield opening 31 and the cryopanel 58 closest to the additional shield 52. The lower structure 66 has cryopanels 62, 64. The upper and lower structures 60, 66 may include more than two or multiple cryopanels.

A frost accommodating space 70 is provided between the upper structure 60 and the lower structure 66. The frost accommodating space 70 is arranged such that the cryopanel 62 of the upper end of the lower structure 66 condenses a more amount of gas thereon than the cryopanel 58 of the lower end of the upper structure 60. For this, the gap between the lower end cryopanel 58 in the upper structure 60 and the upper end cryopanel 62 in the lower structure 66 has a width larger than the gap between the two cryopanels 56, 58 in the upper structure 60. Also, the upper end cryopanel 62 in the lower structure 66 is disposed below the additional shield 52. Accordingly, a sufficient volume is provided above the upper end cryopanel 62 in the lower structure 66, on which a significant amount of frost may be deposited before the deposited frost touches the additional shield 52 and any other components with a higher temperature.

Also, the gap between the lower end cryopanel 58 in the upper structure 58 and the upper end cryopanel 62 in the lower structure 66 has a width larger than the gap between the two cryopanels in the lower structure 66. Such a dense arrangement of the cryopanels in the lower structure 66 provides a large cryopanel area per volume in the lower region of the shield inside space. This is helpful to improve the maximum pumping capacity of the cryopump. In addition, the lower structure 66 is disposed below the intake slit 54 such that gas molecules entering through the intake slit 54 to the cryopump bottom can be effectively captured on the lower structure 66.

The top cryopanel 56 has a central panel 72 facing to the shield opening 31 and a peripheral panel 74 extending from the periphery of the central panel 72. The central panel 72 is a disk-shaped panel disposed perpendicularly to the shield central axis. The peripheral panel 74 extends towards the adjacent cryopanel 58 in parallel with the shield central axis. The peripheral panel 74 is a cylindrical panel extending downwardly from the periphery of the central panel 72. An adsorbent is provided on the backside of the central panel 72 and the internal surface of the peripheral panel 74. The peripheral panel 74 extends toward the bottom of the cryopump at a deeper angle than a peripheral portion of the adjacent cryopanel 58. This may allow the peripheral panel 74 to efficiently capture gas molecules entering into the upper region of the shield internal space through the intake slit 54.

It is preferable that the peripheral panel 74 extends downwardly beyond the line defined by the upper edge of the additional shield 52 and the peripheral edge of the central panel 72 in a plane including the shield central axis. Speaking in principle, it is preferable that a cryopanel is disposed such that a condensing surface thereof traverses perpendicularly the gas inflow entering through the intake slit 54. In other words, it is preferable that the condensing surface is arranged on a constant-pressure surface occurred around the intake slit 54. A pressure distribution in the cryopump may be obtained through calculation based on e.g. the Monte Carlo simulation.

Alternatively, the peripheral panel 74 may extend radially outwardly and upwardly. In this case, an adsorbent may not be provided on both sides of the top cryopanel 56 and both sides of the peripheral panel 74 may be utilized as condensing surfaces.

The panel-mounting member 68 has a cylindrical shape, one end of which is occluded and the other end is opened. The occluded end portion is mounted at the upper end of the second cooling stage 24, cylindrical side surface of which extends toward the bottom of the heat shield 16 so as to encompass the second cooling stage 24. The plurality of the panels are mounted in the cylindrical side surface of the panel-mounting member 68 to be spaced apart from each other. In a horizontal-type cryopump, the upper structure 60 and the lower structure 66 are mounted to the second cooling stage 24 by an upper panel mounting member and a lower panel-mounting member, respectively.

In operation of the cryopump 10, the inside of the vacuum chamber 80 is first evacuated to the degree of approximately 1 Pa by using other appropriate roughing pump prior to the operation. Subsequently the cryopump 10 is operated. The first cooling stage 22 and the second cooling stage 24 are cooled by driving the refrigerator 12, allowing the heat shield 16, the baffle 32 and the panel assembly 14, which are thermally connected to the stages, also to be cooled.

The cooled baffle 32 cools gas molecules flying toward the inside of the cryopump 10 from the vacuum chamber 80 to condense a gas (e.g., moisture), vapor pressure of which is sufficiently low at the cooling temperature, on its surface and pump the gas. A gas, vapor pressure of which is not sufficiently low at the cooling temperature of the baffle 32, passes through the baffle 32 to enter the inside of the heat shield 16. Among the gas molecules thus entering the inside, a gas, vapor pressure of which is sufficiently low at the cooling temperature of the panel assembly 14, is condensed on the surface of the structure 14 to be pumped. A gas, vapor pressure of which is not sufficiently low at the cooling temperature, is adsorbed by an adsorbent, which is attached to the surface of the panel assembly 14 and cooled, and pumped. Thus, the cryopump 10 can enhance the degree of vacuum inside the vacuum chamber 80 to a required level.

Figure 2:
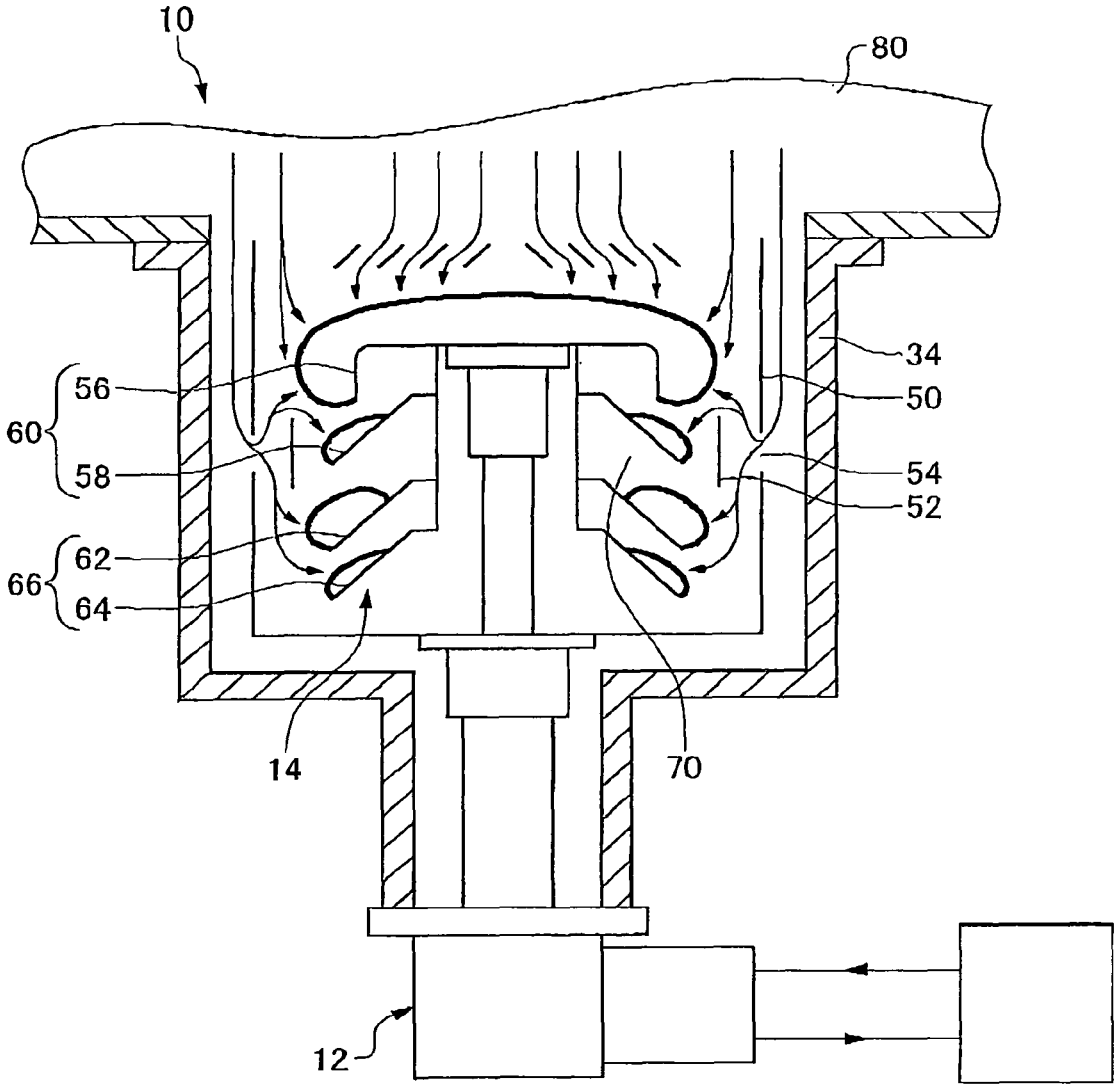
FIG. 2 schematically shows a cryopump during pumping operation according to an embodiment of the present invention.

FIG. 2 is a schematic diagram illustrating the cryopump 10 during an evacuation operation. As illustrated in FIG. 2, an ice layer made of a condensed gas is deposited on the cryopanel assembly 14 of the cryopump 10. When the volume to be evacuated of the cryopump 10 is, for example, a vacuum chamber of a sputtering apparatus, a major constituent of the ice layer is, for example, argon. The ice layer grows during an evacuation operation time, leading to increase in its thickness. In FIG. 2, an arrow schematically represents the gas flow from the vacuum chamber 80 to the internal space of the cryopump.

Figure 3:
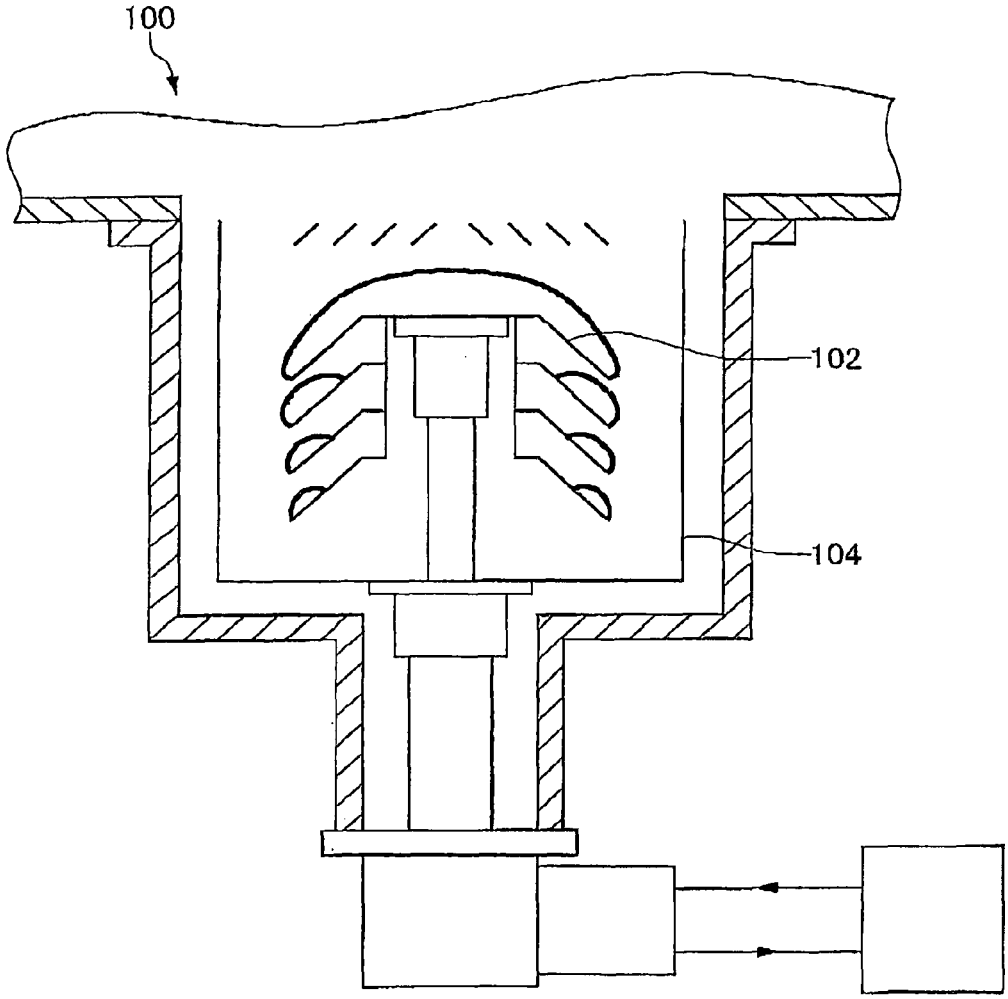
PRIOR ART FIG.3
FIG. 3 schematically shows an example of a cryopump.

FIG. 3 depicts an example of a conventional cryopump 100 during evacuation operation. The cryopump 100 has a plurality of cryopanels 102 arranged at constant intervals. Any cryopanel 102 has an identical shape to another cryopanel. A radiation shield 104 allows agas inflow only froman inlet towards acryopump opening. As shown, a thicker frost layer is deposited on a cryopanel closer to the opening because more gas molecules reach a surface of the closer cryopanel. Accordingly, the largest amount of frost is accumulated on the top cryopanel facing to the opening.

Assuming that the ice layer is not in contact with the radiation shield, the cryopump in principle can perform evacuation before a vapor pressure on the surface of the ice layer accumulating on the low temperature cryopanels exceeds the degree of vacuum to be attained. When the vapor pressure on the surface of the ice layer exceeds the degree of vacuum to be attained, vaporization from the ice layer is predominant over gas condensation from ambient atmosphere to the ice layer, and hence further evacuation cannot be performed. A gas vapor pressure on the surface of the ice layer is determined by the temperature of the surface of ice layer. There occurs temperature distribution in which temperature gradually rises from the surface of the cryopanel to the surface of the ice layer. As the ice layer is growing, its surface temperature is rising. The gas pumping capacity of the cryopump at the time when a vapor pressure on the surface of the ice layer exceeds the degree of vacuum to be attained, determines the maximum pumping capacity of the cryopump.

Consequently, an upper (e.g. the top) cryopanel in the cryopump 100 shown in FIG. 3 determines the maximum pumping capacity due to the concentration of deposited ice on the upper cryopanel. At the same time, a potential capacity of lower cryopanels is not utilized in spite of the fact that the lower cryopanels is still capable of receiving and capturing gas molecules to be pumped.

In contrast to that, the cryopump 10 according to the present embodiment, as shown in FIG. 2, provides a secondary gas pathway in addition to the main gas pathway from the shield opening 31 to the inside. In the secondary pathway, a gas enters into a gap between the pump case 34 and the main shield 50, passes through the gap along the direction in the shield central axis, and reaches the inside of the shield through the intake slit 54. The additional shield 52 guides upwardly or downwardly gas molecules that have reached the inside. The gas molecules guided upwardly over the additional shield 52 are condensed on the surfaces of the cryopanels 56, 58 of the upper structure 60, and the gas molecules guided downwardly below the additional shield 52 are condensed on the surfaces of the cryopanels 62, 64 of the lower structure 66.

An experimental result was obtained. The measurement of the maximum amount of condensed gas was performed on the same conditions for a cryopump 10 according to the present embodiment and a cryopump 100 in FIG. 3 for reference with the same cryopump diameter as the cryopump 10. The maximum condensing amount of argon was 1,000 liters in the cryopump 10 of the present embodiment, and 800 liters in the cryopump 100. The cryopump 10 of the embodiment has a larger amount one and quarter times than the conventional cryopump 100. Also, the maximum condensing amount of nitrogen was 900 liters in the cryopump 10 of the present embodiment, and 600 liters in the cryopump 100. The cryopump 10 of the embodiment has a larger amount one and half times than the conventional cryopump 100. The maximum amount was determined as the maximum condensed amount that the pressure falls down less than $1.33*10^{-5}$ Pa during a temporary stop of gas flow in thirty seconds after every constant gas inflow of 25 liters with 1,000 sccm.

In the present embodiment, the additional gas pathway is provided to facilitate gas flowing into the inside of the cryopump in addition to the main gas pathway. Accordingly, the pumping capacity of the lower cryopanels, in which gas molecules are difficult to reach through the main pathway, is practically utilized. Therefore, the maximum pumping capacity of the cryopump is improved.

Also, the frost accommodating space 70 is provided between the upper structure 60 and the lower structure 66 to be connected with the intake slit 54. The accommodating space 70 allows a significantly thick ice layer to deposit on the surfaces of the cryopanels surrounding the space 70. A thick ice layer is deposited on the upper cryopanel 62 in the lower structure 66. Accordingly, the potential pumping capacity of the lower cryopanels is utilized.

The present invention has been described above based on the embodiments. It should be appreciated by those skilled in the art that the invention is not limited to the above embodiments but various design changes and variations can be made, and such variations are also encompassed by the present invention.

Figure 4:
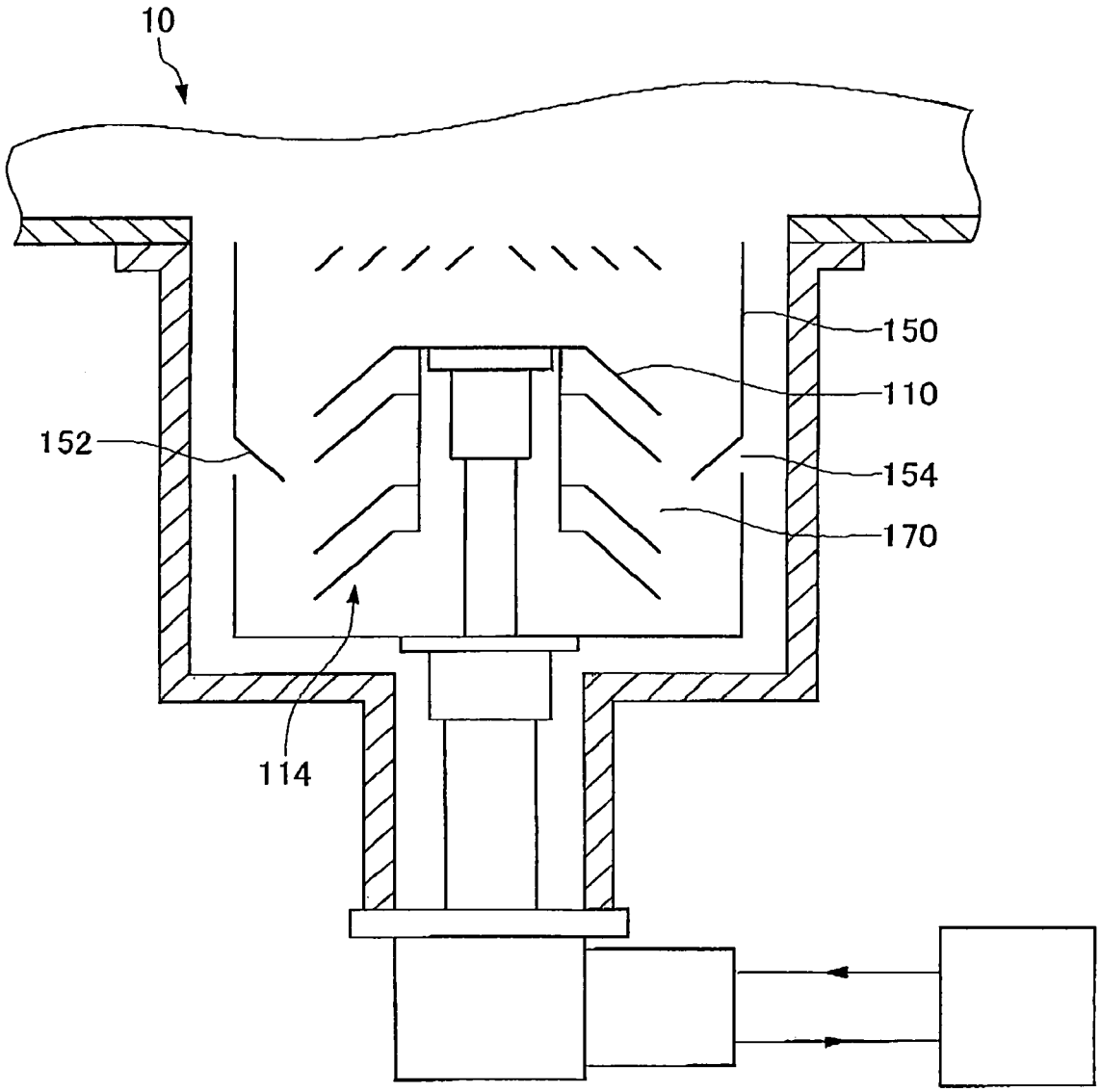
FIG. 4 schematically shows a cryopump according to another embodiment of the present invention.

For example, as shown in FIG. 4, all the cryopanels 110 may be configured in the same shape. A frost accommodating space 170 may be provided such that the gap between the two adjacent cryopanels corresponding to the position of a sub-inlet 154 in the shield central axial direction is wider than a different gap between any other adjacent cryopanels. The cryopanels 170 may be arranged at variable intervals associated with the position of the sub-inlet 154.

In an embodiment, an additional shield 152 may be formed so as to guide a gas entering into the shield through the sub-inlet 154. It may allow the gas to efficiently guide a lower structure of the cryopanel assembly 114. Therefore, as shown, the additional shield 152 may be formed continuously from an upper part of the main shield 150. The additional shield may extend radially inwardly and downwardly to the bottom of the cryopump.

In another embodiment, more than one sub-inlets may be arranged at positions in the shield central axial direction. In this case, more than one frost accommodating spaces may be formed at corresponding positions to the sub-inlets in the axial direction. In an example where two sub-inlets are provided, a cryopanel assembly may be divided into an upper sub-assembly, an intermediate sub-assembly, and a lower sub-assembly such that each space between adjacent sub-assemblies is associated with a respective sub-inlet. Also, the cryopanels may be arranged at variable intervals such that each frost accommodating space has a desired volume formed adjacently to a respective sub-inlet.

A cryopanel may have the above-described umbrella-like shape and any other suitable shape. In an embodiment, a plurality of flat panels may extend outwardly in a radial direction. Each flat panel may be arranged in a plane including the shield center axis. A frost accommodating space may also be formed between an upper structure and a lower structure of a cryopanel assembly.

What is claimed is:

1. A cryopump comprising:

a radiation shield provided with a main inlet at one end thereof and a sub-inlet in a side thereof; and a cryopanel assembly cooled to a temperature lower than that of the radiation shield, the cryopanel assembly including an upper structure having at least one cryopanel and a lower structure having at least one cryopanel, the upper and lower structures arranged inside the radiation shield along a direction away from the main inlet, wherein a frost accommodating space connected to the sub-inlet is arranged between the upper and lower structures such that an amount of captured gas on an upper end cryopanel of the lower structure is greater than an amount of captured gas on a lower end cryopanel of the upper structure.

2. The cryopump according to claim 1, wherein the frost accommodating space is formed by positioning the lower structure below the sub-inlet.

3. The cryopump according to claim 1, wherein at least one of the upper and lower structures comprises a plurality of cryopanels, the upper and lower structures are spaced apart at a larger distance than a gap between the plurality of cryopanels.

4. The cryopump according to claim 1, wherein atop cryopanel is arranged closest to the main inlet, the top cryopanel includes a central panel facing to the main inlet and a peripheral panel extending from a peripheral portion of the central panel towards a cryopanel adjacent to the top cryopanel.

5. A cryopump comprising:

a radiation shield including a main shield provided with a main inlet at one end thereof and a sub-inlet in a side thereof, and a additional shield facing to the sub-inlet; and a plurality of cryopanels surrounded by the radiation shield and arranged spaced apart each other along a direction from the main inlet to an internal volume of the radiation shield, wherein a gap between a cryopanel closest to the additional shield and a cryopanel adjacently arranged towards a bottom of the radiation shield is different from a gap between the cryopanel closest to the additional shield and a cryopanel adjacently arranged towards the main inlet.

6. The cryopanel according to claim 5, wherein the gap between the cryopanel closest to the additional shield and the cryopanel adjacently arranged towards the bottom of the radiation shield is greater than the gap between the cryopanel closest to the additional shield and the cryopanel adjacently arranged towards the main inlet.

* * * * *